US009206714B2

(12) United States Patent
Koehler

(10) Patent No.: US 9,206,714 B2
(45) Date of Patent: Dec. 8, 2015

(54) CONTROL VALVE FOR HYDRAULIC DEVICE

(71) Applicant: Schaeffler Technologies AG & Co. KG, Herzogenaurach (DE)

(72) Inventor: David Koehler, Egloffstein (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 6 days.

(21) Appl. No.: 13/897,852

(22) Filed: May 20, 2013

(65) Prior Publication Data

US 2013/0312678 A1 Nov. 28, 2013

(30) Foreign Application Priority Data

May 23, 2012 (DE) ..... 10 2012 208 591

(51) Int. Cl.
*F01L 1/34* (2006.01)
*F01L 1/344* (2006.01)

(52) U.S. Cl.
CPC ..... *F01L 1/3442* (2013.01); *F01L 2001/34426* (2013.01); *F01L 2001/34433* (2013.01)

(58) Field of Classification Search
CPC ..... F01L 2001/3442; F01L 2001/34426; F01L 2001/34433; F01L 1/46
USPC ..... 123/90.12, 90.15–90.18; 137/625.69
See application file for complete search history.

(56) References Cited

U.S. PATENT DOCUMENTS

2007/0095315 A1 5/2007 Hoppe et al.
2010/0288384 A1 11/2010 Hoppe et al.
2012/0145105 A1* 6/2012 Bayrakdar ..... 123/90.17

FOREIGN PATENT DOCUMENTS

DE 102005052481 5/2007
DE 102008004591 7/2009
DE 10 2008 030 057 A1 1/2010
DE 102009039384 A1 * 3/2011
WO WO 2009092610 A1 * 7/2009

* cited by examiner

*Primary Examiner* — Thomas Denion
*Assistant Examiner* — Daniel Bernstein
(74) *Attorney, Agent, or Firm* — Davidson, Davidson & Kappel, LLC

(57) ABSTRACT

Control valve for a device, in particular for a hydraulic control device, for variably setting the control times of gas exchange valves in internal combustion engines, including a housing component, a control piston and a retaining ring, the control piston being movably mounted, loaded by a spring, on the one hand, and limited with the aid of the retaining ring, on the other hand, the retaining ring projecting over the control piston in the radial direction and being fixable in the axial direction in a recess in the housing component, and a control sleeve and a plastic shell surrounding the control sleeve being provided between the control piston and the housing component, and the retaining ring being axially attachable to the plastic shell in addition to being fixable to the housing component, and limiting the movement of the control piston and/or the control sleeve.

12 Claims, 2 Drawing Sheets

CONTROL VALVE FOR HYDRAULIC DEVICE

This claims the benefit of German Patent Application DE 10 2012 208 591.2, filed May 23, 2012 and hereby incorporated by reference herein.

A control valve for a device, in particular for a hydraulic control device for variably setting the control times of gas exchange valves in internal combustion engines, including a housing component, a control piston and a retaining ring, the control piston being movably mounted, loaded by a spring, on the one hand, and limited by the retaining ring, on the other hand, and the retaining ring projecting over the control piston in the radial direction and being fixable in the axial direction in a recess in the housing component.

BACKGROUND

A corresponding control valve is known from DE 10 2008 030 057 A1. In this control valve, the housing component is designed as a hollow screw and it is fastened by its end in a cam shaft of a reciprocating internal combustion engine with the aid of a threaded connection. The housing component has corresponding openings or bore holes for a hydraulic pressure medium supplied by the internal combustion engine, for control lines for variably setting the control times of the gas exchange valves and for an outflow. A control piston, which is spring-loaded, on the one hand, and is limited by a retaining ring in the housing component, on the other hand, is guided in the housing component. Due to corresponding axial movements of the control piston in the housing component, the device is acted upon and the variable setting of the control times takes place.

SUMMARY OF THE INVENTION

If the retaining ring is then released and the control piston removed for inspection and repair purposes, individual parts exit the housing component and may enter the interior of the internal combustion engine in an uncontrolled manner, which may cause considerable difficulties. The same applies when the hollow screw is removed, since the device is then disassembled for setting the control times (cam adjusting device), which also results in a great deal of assembly complexity.

An object of the present invention is to eliminate the disadvantages described above and to modify the control valve in such a way that the control valve unit may be disassembled and assembled without exposing individual parts. The modification is to be accomplished using simple, cost-effective means.

The present provides a control sleeve and a plastic shell surrounding the control sleeve between the control piston and the housing component, and the retaining ring is axially attachable to the plastic shell and/or to the control sleeve in addition to being fixable to the housing component and limits the movement of the control piston in relation to the control sleeve and/or the plastic shell.

The present invention provides a plastic shell that is preferably connected to the control sleeve or fastened thereon, for example fixed to the control sleeve by an injection molding process.

Due to this design, the essential components of the control valve can be attached to the plastic shell via the retaining ring, so that this assembly may be mounted or removed as a unit. As a result, only the complete unit needs to be replaced, even if these components are damaged. The housing component may remain mounted, and the control times do not have to be reset.

As a result, a valve housing designed as a hollow screw may be eliminated, and the assembly may be mounted directly in a housing component of any design, e.g., a cam shaft end.

In another embodiment of the present invention, it is proposed that the plastic shell has longitudinal webs which correspond to recesses in the housing component. This ensures that the structural unit may be rotationally accurately reinserted during assembly.

The retaining ring has an inward facing bulge in the arc-shaped connecting area. It also has an insertion chamfer in the inner area of the bulge.

The plastic shell and/or the control sleeve has/have a groove section which is adapted to the retaining ring and a latching tab adapted to the bulge of the retaining ring in the area of the groove section. The latching tab and the insertion chamfer on the retaining ring are located on the same side of the retaining ring.

Based on the aforementioned features, the retaining ring may be inserted into the groove or the groove section in the plastic shell or the injection molding only from one side. The retaining ring may not be inserted from the opposite side because a stop is provided there. It is thus ensured that the retaining ring is placed behind the latching tab with its recess after being inserted, providing an exact fixing of the retaining ring. The stop on the plastic shell prevents an overload of the retaining ring when the retaining ring is compressed.

The insertion chamfer may be used to push the retaining ring more easily into the groove section and thus elastically bend the latching tab. The insertion chamfer also prevents the latching tab from shearing off. The insertion chamfer may be either adjacent to the latching tab or be attached on both sides of the retaining ring. If it is attached on only one side, care must be taken during assembly to ensure that it faces the latching tab during insertion.

Due to the fact that the area assigned to the insertion chamfer and/or the inner projections of the retaining ring assigned to the ends of the legs can project inwardly over the edge of the control piston, it is ensured that the control piston in the control sleeve and the plastic shell is securely fastened in the axial direction for the purpose of removing the structural unit from and mounting the structural unit in the housing component. As a result, the retaining ring also may be centered on the plastic shell and the control piston during removal.

If this structural unit is pushed all the way into the housing component, a final fixing in the housing component takes place by the edges of the retaining ring engaging with a recess, preferably an inner groove on the housing component, by stretching and releasing the retaining ring.

BRIEF DESCRIPTION OF THE DRAWINGS

The present invention is explained below on the basis of the drawings, which illustrate an exemplary embodiment of the present invention in simplified form.

DETAILED DESCRIPTION

Figure 2:
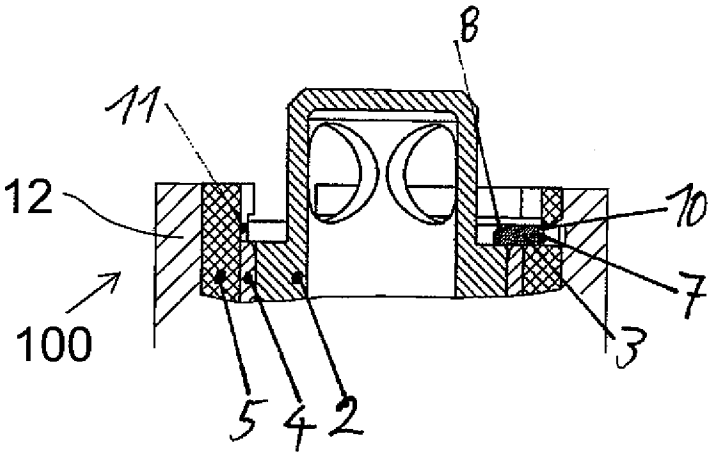
FIG. 2 shows a partial longitudinal section of the control piston, the control sleeve, the plastic shell and the retaining ring.
Figure 1:
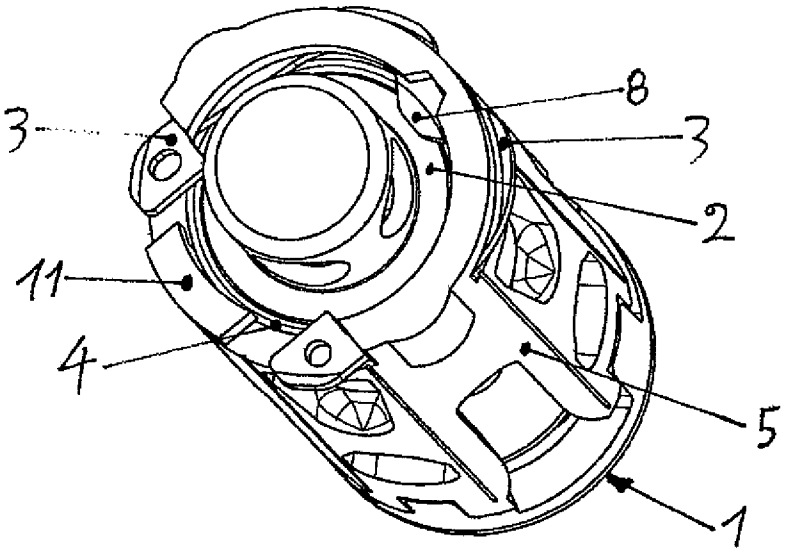
FIG. 1 shows a perspective view of a control valve structural unit without the housing component.
Figure 3:
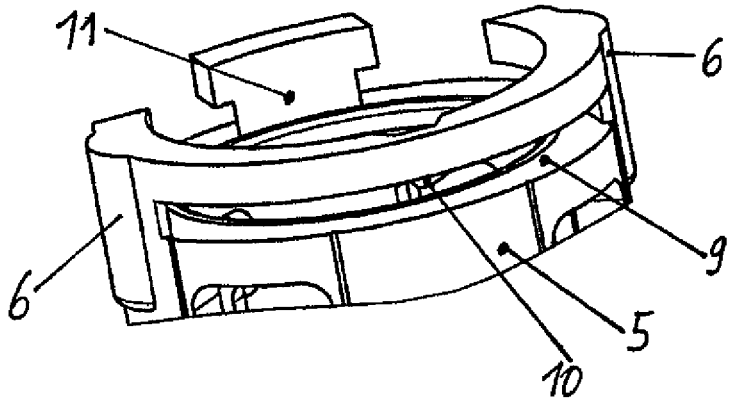
FIG. 3 shows a perspective view of a plastic shell.

In FIGS. 1 through 4, to the extent shown in detail, reference numeral 1 generally identifies a control valve structural unit for a hydraulic control device shown schematically as

100, which has a control piston 2 and a retaining ring 3. As is shown, in particular, in FIG. 4, control piston 2 is situated in a control sleeve 4, which, in turn, is surrounded by a plastic shell 5, which is fitted in a housing component 12 shown schematically. Plastic shell 5 is manufactured as an injection molding around control sleeve 4. Plastic shell 5 has longitudinal webs 6, which ensure an accurately fitting insertion into the housing component.

Figure 4:
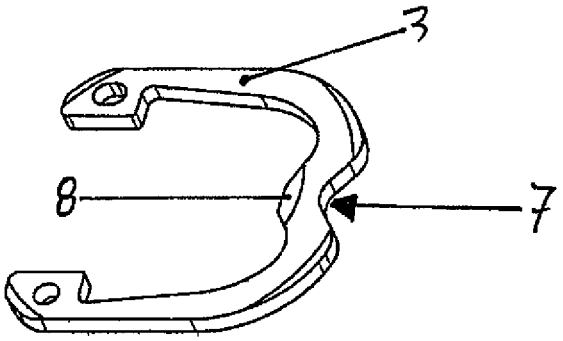
FIG. 4 shows a perspective view of a retaining ring.

As is shown, in particular, in FIG. 4, retaining ring 3 has an inward-facing bulge 7 in the arc-shaped connecting area. An insertion chamfer 8 is provided on the inside of bulge 7, it being possible to additionally provide another insertion chamfer on the side opposite the cross-sectional plane of retaining ring 3. Plastic shell 5 has a groove section 9, as shown for example in FIG. 3, into which a latching tab 10 projects. On the opposite side of groove section 9, a stop 11 is attached on plastic shell 5, which prevents retaining ring 3 from being able to be pushed into plastic shell 5 from the wrong side.

LIST OF REFERENCE NUMERALS

1 Control valve structural unit
2 Control piston
3 Retaining ring
4 Control sleeve
5 Plastic shell
6 Longitudinal webs
7 Bulge
8 Insertion chamfer
9 Groove section
10 Latching tab
11 Stop
12 Housing component
100 Hydraulic control device

What is claimed is:

1. A control valve for a device, comprising:

a housing component;

a control piston;

a retaining ring, the control piston being movably mounted and spring-loaded, on the one hand, and limited by the retaining ring on the other hand, the retaining ring projecting over the control piston in the radial direction and being fixable in the axial direction in a recess in the housing component; and a control sleeve and a plastic shell surrounding the control sleeve between the control piston and the housing component, the retaining ring being axially attachable to at least one of the plastic shell and the control sleeve in addition to being fixable to the housing component, the retaining ring limiting movement of the control piston with respect to at least one of the control sleeve and the plastic shell, the plastic shell having a groove section adapted to the retaining ring; wherein the plastic shell has a latching tab adapted to a bulge of the retaining ring in the area of the groove section, the stop, the groove section and the retaining ring being configured such that the retaining ring is only insertable into the groove section from one side.

2. The control valve as recited in claim 1 wherein the plastic shell is manufactured as an injection molding and connected to the control sleeve.

3. The control valve as recited in claim 1 wherein the plastic shell has longitudinal webs corresponding to recesses in the housing component.

4. The control valve as recited in claim 1 wherein the retaining ring has a bulge in an arc-shaped connecting area thereof.

5. The control valve as recited in claim 1 wherein the retaining ring has an inwardly facing bulge and an insertion chamfer on an inner area of the retaining ring opposing the bulge.

6. The control valve as recited in claim 5 wherein the insertion chamfer is configured to elastically bend the latching tab as the retaining ring is pushed into the groove section.

7. The control valve as recited in claim 1 wherein the plastic shell has a stop in an area opposite the latching tab.

8. The control valve as recited in claim 1 wherein an area opposite a bulge of the retaining ring and/or inner projections of the retaining ring assigned to ends of legs of the retaining ring project inwardly over an edge of the control piston.

9. A hydraulic control device for variably setting the control times of gas exchange valves in internal combustion engines comprising the control vale as recited in claim 1.

10. The control valve as recited in claim 1 wherein the groove section extends between an outer and inner circumference of the plastic shell.

11. The control valve as recited in claim 1 wherein the bulge is formed at an outer surface of the retaining ring and is inward facing.

12. The control valve as recited in claim 1 wherein the stop is arranged such that the bulge of the retaining ring is placed behind the latching tab when the retaining ring is inside into the groove section.

* * * * *